US006512331B1

(12) United States Patent
Fu

(10) Patent No.: US 6,512,331 B1
(45) Date of Patent: Jan. 28, 2003

(54) LUMINOUS DISPLAY AND METHOD OF MAKING SAME

(76) Inventor: Hing Hung Ricky Fu, Unit 8, 9F., Chai Wan industrial City Phase I, No. 60, Wing Tai Road, Chai Wan, Hong Kong (CN)

( * ) Notice: Subject to any disclaimer, the term of this patent is extended or adjusted under 35 U.S.C. 154(b) by 184 days.

(21) Appl. No.: 09/708,718

(22) Filed: Nov. 9, 2000

(51) Int. Cl.[7] ..... H01J 1/62; H01J 63/04; F21K 1/00; G09F 13/26

(52) U.S. Cl. ..... 313/609; 313/483; 313/610; 313/612; 362/263; 362/318; 40/545; 40/615

(58) Field of Search ..... 313/607–611, 483–485, 313/609, 623, 636, 493, 495, 634, 567, 514, 515, 513; 40/545, 541–544; 362/364, 255, 260, 263, 337, 357, 318, 332

(56) References Cited

U.S. PATENT DOCUMENTS

| | | | | | |
|---|---|---|---|---|---|
| 3,190,178 | A | * | 6/1965 | McKenzie | 116/63 P |
| 3,405,025 | A | * | 10/1968 | Goldman | 156/247 |
| 4,403,831 | A | * | 9/1983 | Amano | 345/60 |
| 4,584,501 | A | * | 4/1986 | Cocks et al. | 313/493 |
| 4,703,574 | A | * | 11/1987 | Garjian | 40/545 |
| 4,742,278 | A | * | 5/1988 | Iannini | 315/227 R |
| 4,990,826 | A | * | 2/1991 | Cocks et al. | 313/485 |
| 5,036,243 | A | * | 7/1991 | Cocks et al. | 313/39 |
| 5,051,648 | A | * | 9/1991 | Misono et al. | 313/13 |
| 5,089,745 | A | * | 2/1992 | Iannini | 116/202 |
| 5,126,632 | A | * | 6/1992 | Parker | 313/516 |
| 5,281,898 | A | | 1/1994 | Albright | 313/610 |
| 5,383,295 | A | | 1/1995 | Strattman | 313/610 |

* cited by examiner

*Primary Examiner*—Nimeshkumar D. Patel
*Assistant Examiner*—German Colon
(74) *Attorney, Agent, or Firm*—Hall, Priddy, Myers & Vande Sande

(57) ABSTRACT

A luminous display device and method of making the same wherein a front member of transparent glass (16) is fused to the rim area (4) of a rear member (1) having a recess (8) therein and protuberances (12) projecting from the base of the recess toward the front member, the protuberances being closely spaced with respect to each other and the front member to provide passages (14) between the protuberances and a light discharge chamber (20) between the front member and the recess. An opening (22) extends through the rear member communicating with the chamber. A tubular member (26) mounted on the rear member communicates with the opening for evacuating the chamber and filling it with ionizable gas. An electrode device (28) is mounted in the tubular member and is operatively connected to a power source (36) for ionizing the gas in the chamber thereby producing light discharge fingers (38,40,42,44) or streaks through the passages providing the desired display of light.

According to the method, rear member (1) is molded to form the recess and protuberances (12) integral therewith thus minimizing the number of parts of the display device.

10 Claims, 6 Drawing Sheets

LUMINOUS DISPLAY AND METHOD OF MAKING SAME

BACKGROUND OF THE INVENTION

This invention relates generally to luminescent display devices and to a method of manufacturing the same. More particularly the invention relates to gas plasma display devices.

It is well known to produce light by the passage of electricity through gases. This phenomenon has been used in lighted signs which display numerals, characters, symbols, graphics and the like, such as in neon signs for example. Gases commonly used for this purpose are neon, argon, mercury vapor, or mixtures thereof.

U.S. Pat. No. 5,383,295 shows a rather common type of flat display device wherein three glass or plastic plates are fused together to form a sandwich, the outer plates being continuous planes and the central plate having a major portion of its central part removed forming a chamber for containing the desired inert gas. A quantity of frit or beads fills the interior chamber and serves as a separator providing uniform space between the plates and a multitude of discharge channels for the electrical discharge produced by a power supply of radio frequency voltage fed by an electrode to the interior chamber. The glass beads serve to resist collapse of the outer surface plates, particularly during fabrication of the device, and when in use maintain uniform spacing between central areas of the outer plates. A tubular element attached centrally to one of the outer plates at a hole therethrough is used to evacuate the interior chamber and introduce an inert gas into the chamber. An electrode is then mounted in the tubular element in contacting relationship with the gas so that voltage supplied through the electrode ionizes the gas to produce fingers of light discharge extending radially outwardly from the center in the intersticial spaces between the beads thereby resulting in the desired display. The teachings of this patent are incorporated by reference herein.

U.S. Pat. No. 5,126,632 shows a display device similar to that discussed above wherein an electrode surface is provided on at least one side of the gas space for ionizing the gas and may be indicia shaped, or other graphic image shaped, to produce a shaped pattern of light for use as a sign, indicator or similar device. therethrough U.S. Pat. No. 5,281,898 shows a glass double walled enclosure of cylindrical or spherical shape defining a chamber for containing an ionized gas discharge among dielectric pellets or beads. Electrodes are attached to ends of the enclosure and are connected to a transformer for supplying high voltage sufficient to produce visible discharges in the gas discharge area.

U.S. Pat. No. 4,403,831 shows a display device wherein two panels are sealed at their edges in spaced relation to provide a discharge chamber therebetween. Electrodes are positioned on opposing spaced surfaces of the panels in the chamber and spaced glass beads are positioned between panels in the chamber to act as spacers.

These prior art devices have the disadvantages of requiring numerous separate parts adding to the cost of materials and fabrication of the devices as well as excessive amounts of gas. In addition, shapes and configurations of images to be produced by the light discharge are unduly limited.

SUMMARY OF THE INVENTION

It is a principle object of the invention to provide a luminous display device which overcomes the above disadvantages by having a minimum number of parts and minimum gas requirement which minimizes the cost of materials, simplifies the assembly procedure, and reduces fabrication costs.

It is a further object of the invention to provide a luminous display device having a central pattern area that can be made in a large variation of shapes.

It is another object of the invention to provide a method of producing a luminous display device which is simplified relative to previous methods required for such devices having a greater number of parts.

The above objects are achieved by the invention wherein the display device is made of only two parts, the first of which is planar in shape and the second of which has an integral gas containing cavity or recess formed therein together with a plurality of semi-spherical or other shaped elements also integral with the second part and positioned in the cavity. The display device can also be curved in shape, or otherwise shaped such as undulated for example, whereby the first and second parts, the cavity and array of semi-spherical elements therein all have the same or corresponding shape. More particularly, the two parts are made of glass or plastic material and at least the first part is transparent. The second part is preferably molded to form the cavity therein and the array of semi-spherical elements protruding from the base of the cavity. The first and second parts are fused together at their peripheral areas to form a sealed gas discharge chamber therebetween with the semi-spherical elements protruding from the base of the cavity toward the first part and in closely spaced proximity thereto so that the interstices between the semi-spherical protrusions provide channels or paths for guiding the light discharges in the form of fingers or streaks through the device to produce the desired display. A hole is provided in the first or second part having an inner end communicating with the chamber and an outer end communicating with a tubular element mounted on the first or second part used for evacuating and filling the chamber with the desired inert gas. An electrode is mounted and supported in the tubular element and is connectable to a power source for ionizing the gas thereby producing the light discharges through the gas in the chamber. The hole is positioned off center with respect to the generally geometric center of the chamber or array of semispherical protrusions, for example about half the distance between the center and the periphery of the chamber.

The device of this invention is made by the method wherein the first part is cut from a sheet of glass, or molded, the second part is molded in a suitable mold producing a cavity having a base in one side of a glass member and a plurality of protuberances protruding from the base toward the open side of the cavity, the protuberances having the shape of semi-spherical elements, or other suitable shapes, closely spaced with respect to each other to provide channels or interstices therebetween, placing the first part over the cavity and in contacting relationship with the peripheral area of the second part around the cavity, and fusing the contacting areas together to seal the cavity and form a light discharge chamber in the joined assembly. A hole is made through the first or second part communicating at its inner end with the chamber at a position off center with respect to the area covered by the chamber, preferably about half the distance between the geometric center and periphery of the chamber. A tubular member is connected at one end to the outer end of the hole for use in evacuating and filling the chamber with the desired inert gas and also for housing the electrode which is mounted therein. The hole can be made during the molding of the first or second part or by drilling after the respective part has been made.

BRIEF DESCRIPTION OF THE DRAWINGS

The invention will now be described in greater detail with reference to the accompanying drawings wherein.

DETAILED DESCRIPTION OF THE INVENTION

Figure 1:
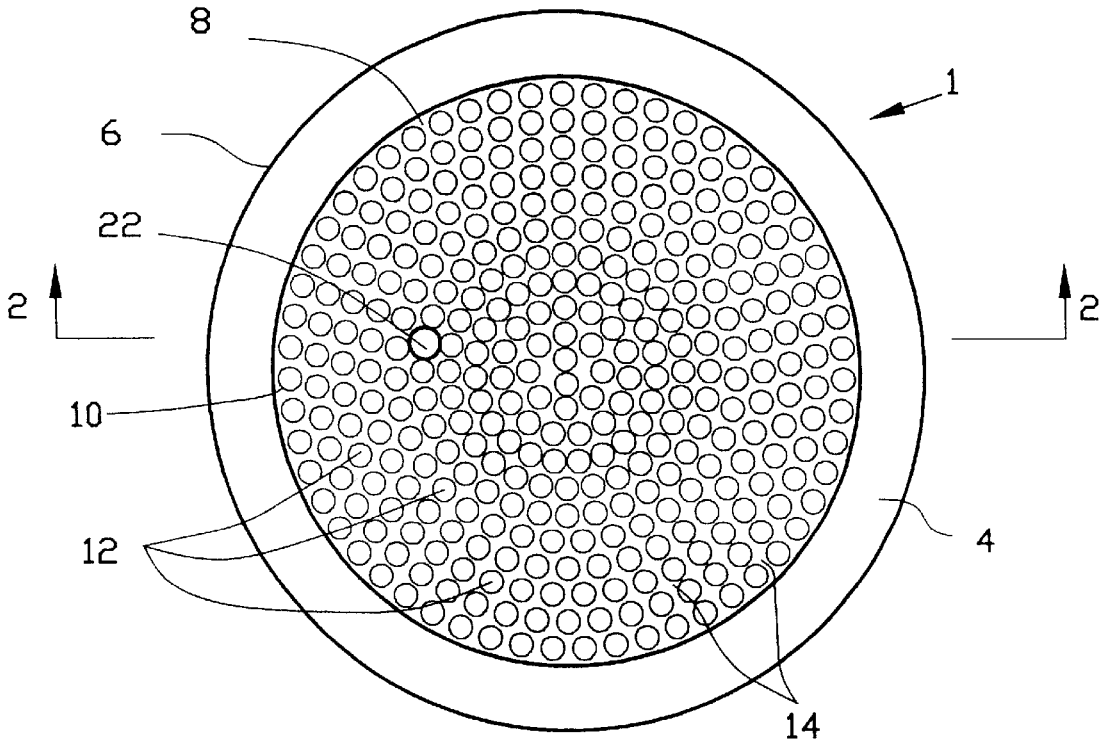
FIG. 1 is top plan view of the second part, or rear glass, of a first embodiment of the invention.
Figure 2:
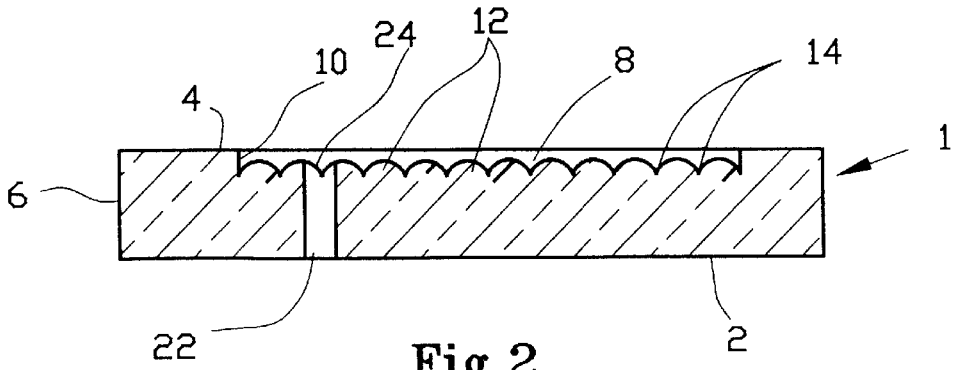
FIG. 2 is a cross-sectional view taken along line 2—2 of FIG. 1.

In the first embodiment of the invention, shown in FIGS. 1–5, the rear glass 1 is preferably glass formed by molding in a suitable mold device (not shown) in the shape of a circular body, with a diameter of about 300 mm for example, having a rear surface 2, a front surface 4 and an outer peripheral surface 6. A circular recess or cavity 8 is formed in the front surface 4 and has a peripheral radially outer surface 10 extending to the depth, or bottom, of the cavity. A plurality of substantially semi-spherical elements, or protuberances, 12 extend upwardly, as shown in FIG. 2 from the bottom of the cavity to a height less than that of the peripheral surface 10 for a reason that will become apparent in the further description below. This construction provides intersticial passages 14 between adjacent elements 12 throughout the array of elements 12 covering the bottom of the cavity 8, as will be readily seen in FIG. 1. The elements 12 could also be pyramidal, conical,or prismatic in shape to provide the intersticial passages 14 between adjacent elements.

Figure 3:
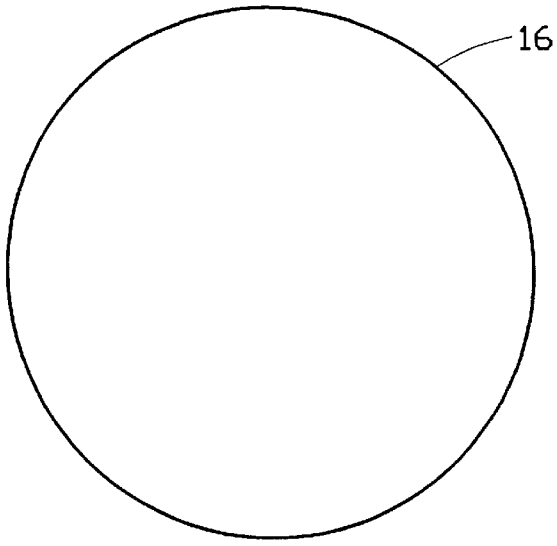
FIG. 3 is a top plan view of the first part, or front glass, of a first embodiment of the invention.
Figure 5:
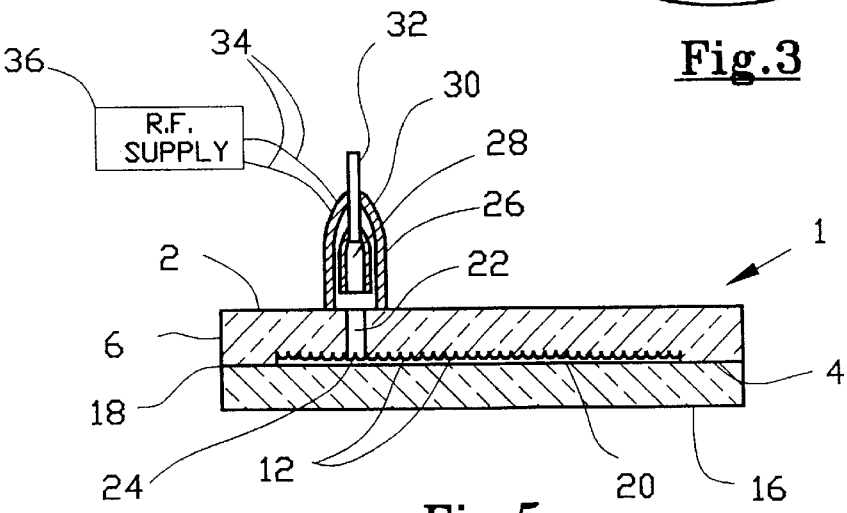
FIG. 5 is a diametrical cross-sectional view of the assembly of the first embodiment of the invention taken along line 5—5 of FIG.4.

FIG. 3 shows a plan view of the front glass 16 which is a substantially planar transparent glass having a circular shape with essentially the same diameter as that of rear glass 1. The front glass 16 and rear glass 1 are assembled together so that the peripheral area of glass 16 is in abutting contacting relationship with the surface 4 of rear glass 1. These contacting surfaces are fused together at the interface 18 to form a sealed chamber 20, as shown in FIG. 5, containing the protuberances 12 in closely spaced proximity to the inner surface of front glass 16. The fusing at interface 18 is at a temperature controlled to produce the fusing but not high enough to cause significant deformation or collapse of the front glass which could affect the volume of chamber 20. A hole 22 is formed in rear glass 1 having an inner end 24 communicating with chamber 20. Hole 22 can be formed during molding of the rear glass, or by drilling thereafter.

A tubular element 26 of glass, or other suitable material, see FIG. 5, is attached it one end to surface 2 of rear glass 1 over the outer end of hole 22 by solder glass to seal the connection at a temperature well below that used for fusing the rear and front glasses together. An electrode 28 having attached leads 34 is positioned in the member 26 and has attached thereto an extension tube 32, these elements being sealed and providing stem support for electrode 28 by forming a stem press 30 in a manner similar to that employed in a conventional incandescent bulb, as described in U.S. Pat. No. 5,383,295 incorporated herein by reference. As well known in the art, leads 34 are made of or coated with a material having an expansion rate compatible with that of the glass of the stem press 30, which is pressed down upon the leads when in a molten state to form a seal when hardened.

Figure 4:
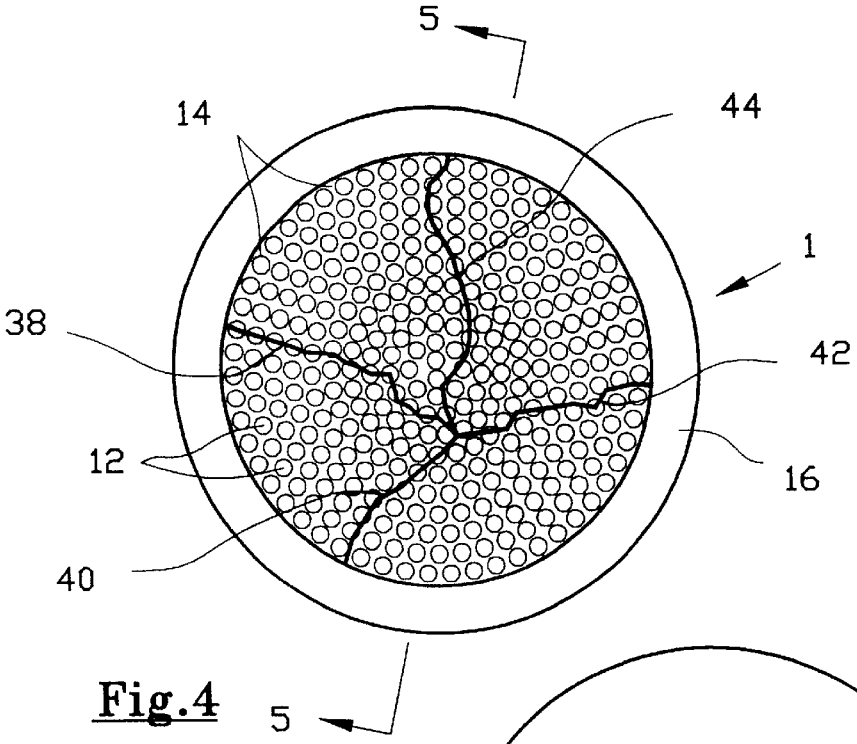
FIG. 4 is top plan view of the assembled parts of FIGS. 1,2 and 3 as viewed through the transparent first part.

Prior to fusing the front and rear glasses together, the protuberances 12 can be coated with any color of material ,such as phosphors, that will produce the desired color of the display device, or can be left uncoated. The assembled device is finally prepared for use by evacuating chamber 20 by a suitable pump or equivalent device well known in the art to the desired pressure, e.g. about 15 microns, through tube 32. The desired gas of any type for producing the color or brilliance desired is then introduced through tube 32 and hole 22 into chamber 20. The gas can be neon, argon, mercury vapor, or mixtures thereof for example. After filling the chamber with gas, tube 32 is sealed by heating or melting, for example, or by a suitable valve device well known in the art (not shown). Lead wires 34 are connected to a power supply 36 with suitable switching to produce voltage in the range of about one to seven thousand kilovolts or higher and a frequency of about 20,000–50,000 Hz. or higher. Electrode 28 when energized with this high voltage causes the gas in chamber 20 to ionize and produce streaks or fingers of light discharge 38, 40, 42, 44 , as shown in FIG. 4, outwardly from the hole through the interstices between protuberances 12. Even though a single electrode is used the gas is ionized because there is sufficient capacitance between the ionized gas and ground to produce it. The fingers of light discharge move randomly throughout the array thereby resulting in the desired display.

Although the first embodiment has been described as circular in configuration, with a diameter of about 300 mm, it is to be understood that the device could be of many shapes, such as a star, rose, Christmas tree, Mickey Mouse head, etc. In addition, although the electrode and evacuation and charging devices are shown as using a common hole, the electrode can have a separate and independent access hole to the chamber.

Figure 6:
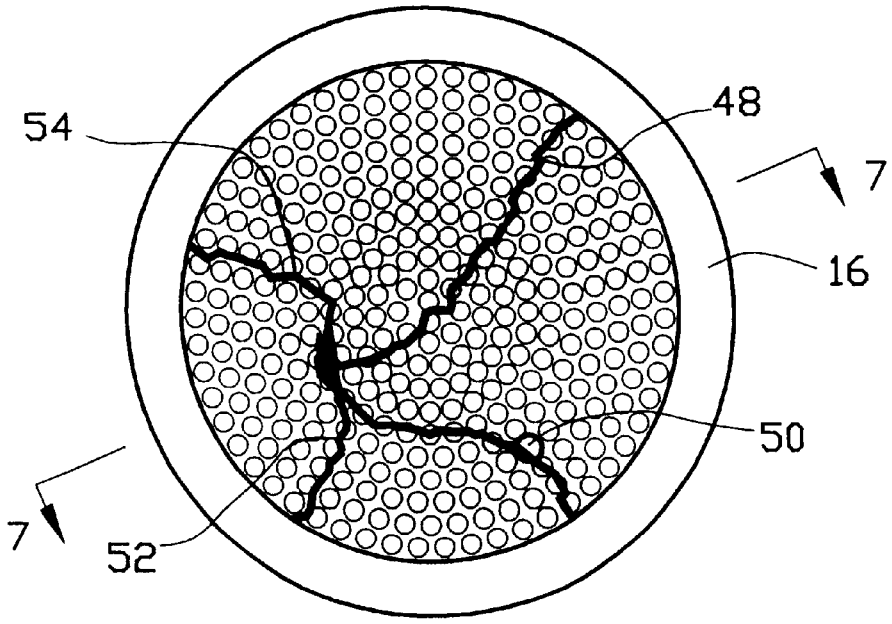
FIG. 6 is a top plan view of the assembled parts of the second embodiment, as viewed through the transparent first part.
Figure 7:
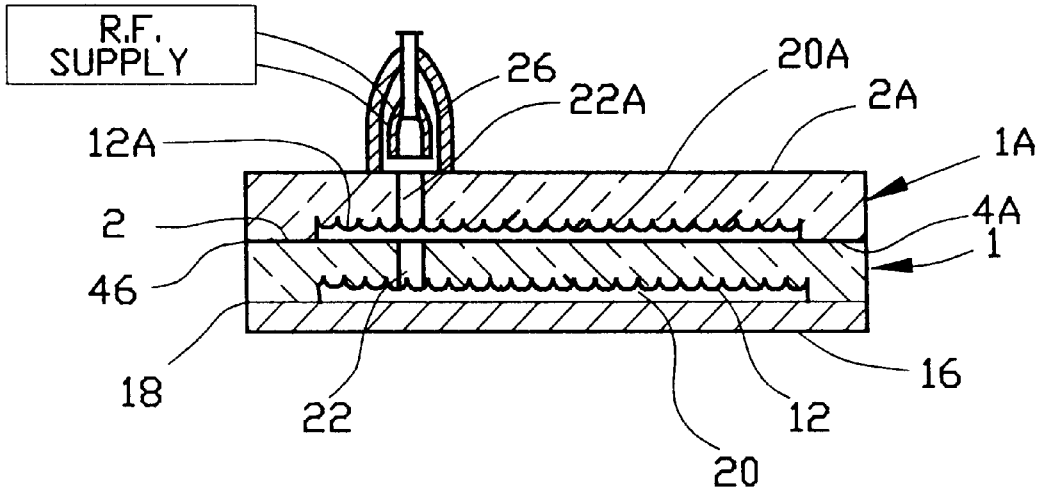
FIG. 7 is a diametrical cross-sectional view of the assembly of the second embodiment of the invention taken along line 7—7 of FIG. 6.

In a second embodiment, the display device has two rear glass members 1, 1A stacked together, as shown in FIG. 7, to provide two separate gas discharge chambers 20,20A for displaying different colors and/or two sets of light discharge fingers or patterns simultaneously. In this case the front surface 4A of second rear glass 1A is fused in sealing engagement with the rear surface 2 of first rear glass 1 at the interface 46 therebetween. Hole 22A is provided in the second rear glass communicating at its inner end with second chamber 20A, which communicates with the outer end of hole 22 in the first rear glass. In addition, tubular element 26 is attached to rear surface 2A of second rear glass 1A in the same manner as described above with regard to the first embodiment and FIG. 5. Different color phosphors can be coated on the protuberances 12 and 12A to produce different colors in the display, if desired. Of course the first rear glass 1 in this embodiment is transparent so that additional light discharge fingers 48,50,52,54 in chamber 20A are visible such as shown in FIG. 6, for example. Second rear glass 1A can also be transparent.

Figure 8:
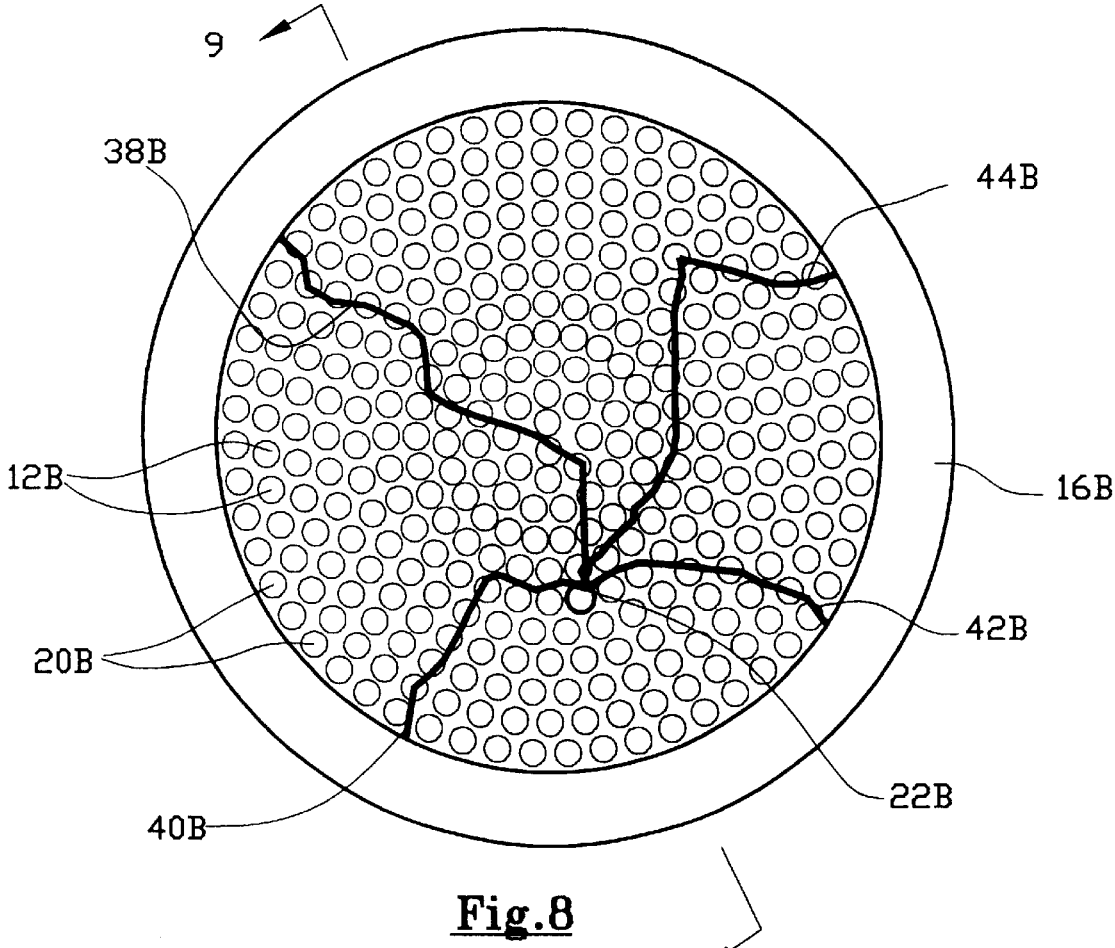
FIG. 8 is a top plan view of the assembled parts of the third embodiment as viewed through the transparent first part.
Figure 9:
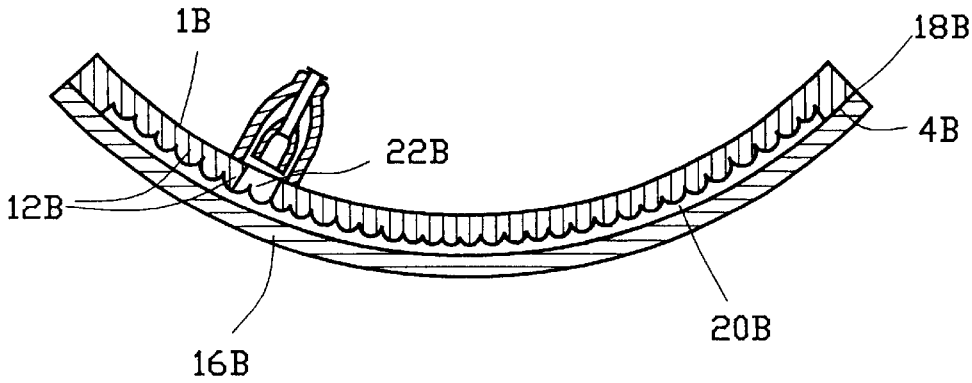
FIG. 9 is a diametrical cross-sectional view of the assembly of the third embodiment of the invention taken along line 9—9 of FIG. 8.

In a third embodiment of the invention, shown in FIGS. 8 and 9, the display device is curved or actuate shaped, but otherwise is the same as the first embodiment. The front and rear glass elements 1B and 16B, respectively, can be initially formed by molding into the desired curved shape and then fused together as described above, or can be formed as described in the first embodiment and thereafter heated and shaped to have the desired curvature.

Figure 10:
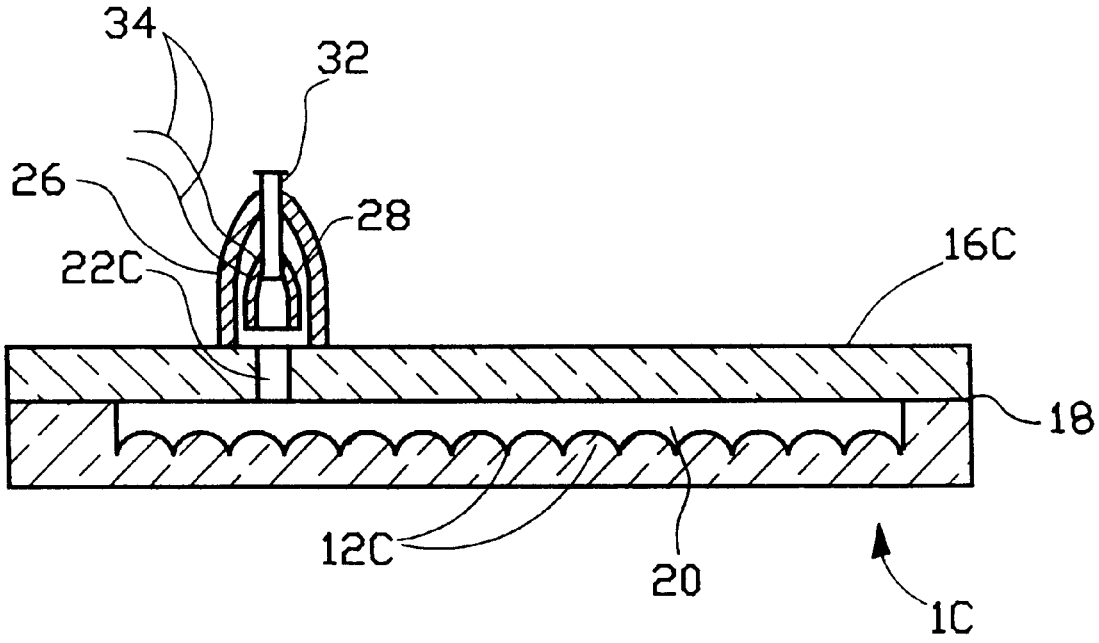
FIG. 10 is a view similar to FIG. 5 showing a fourth embodiment of the invention.

In a fourth embodiment of the invention, shown in FIG. 10, the evacuation and gas filling hole is made in the front member 16C as shown at 22C instead of in rear member 1C. The tubular element 26 is accordingly mounted on the outer surface of member 16C over the outer end of hole 22C in the same manner as described with respect to the first embodiment.

In further embodiments of the invention, the display device can have various configurations, such as undulating or wave shape. These further embodiments would be made and formed in a manner similar to that described above with reference to the third embodiment.

Figure 11:
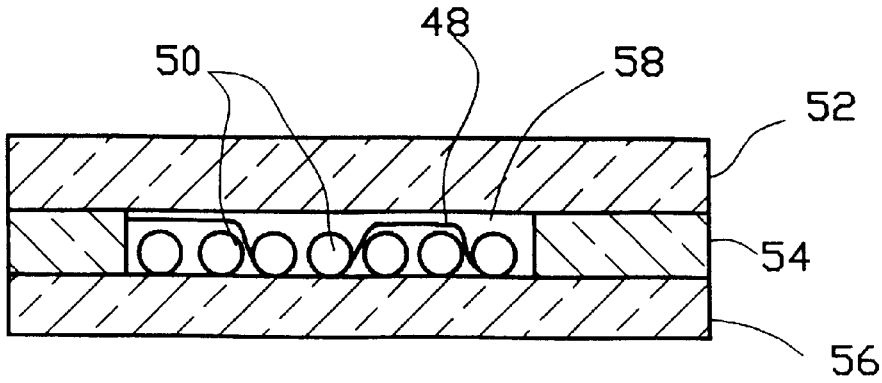
Fig.11 PRIOR ART
FIG. 11 is a schematic cross-sectional view of a prior art display device.

The schematic cross-sectional view of FIG. 11 shows the possible irregularity of the light discharge streaks or fingers 48 in prior art display devices utilizing spherical beads 50 between a plurality of glass plate members 52, 54,56 in gas discharge chamber 58. The light discharge fingers may move up and down around the beads so that a viewer of the display from either above or below will have an impeded view in the least of the light emitted on the opposite side of the beads, thereby reducing the brightness of the display.

Figure 12:
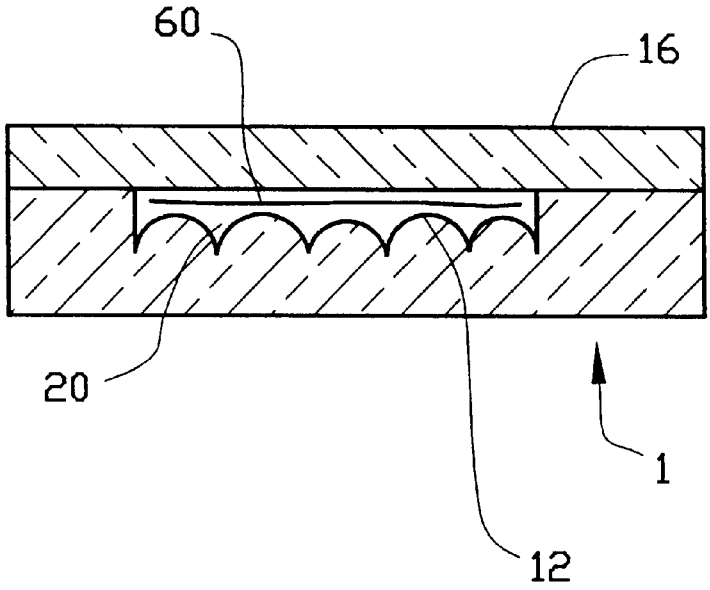
FIG. 12 is a schematic cross-sectional view of the first embodiment of the invention showing the advantage of even brightness of the discharge fingers.

The schematic cross-sectional view of FIG. 12 shows that according to the instant invention the light discharge fingers 60 can only be in the ionization chamber 20 on the side between the protuberances 12 and the front member 16. Therefore, there will be no variation or reduction in the brightness of the emitted light viewed from the front.

Although preferred embodiments of the invention have been disclosed, it should be understood that the spirit and scope of the invention is to be limited solely by the appended claims, since modifications may appear to those skilled in the art.

I claim:

1. A luminous display device comprising:

a front member of transparent glass having a rear surface and a substantially flat area on at least part of said rear surface;

a rear member having a front side and a rear side, a generally central recess in said front side, a plurality of protuberances integral with and extending from said rear member in said recess toward said front side, and a substantially flat peripheral front surface surrounding said recess and engaging said substantially flat area on said rear surface on said front member in fused sealing relationship therewith;

a light discharge chamber between said recess and said front member, said protuberances being in close adjacent relationship with respect to each other to form an array of protuberances having light discharge passages therebetween extending through said array;

an ionizable gas filling said chamber;

an opening in one of said front and rear members having an inner end communicating with said chamber and an outer end;

electrode means communicating with said outer end; and an electrical power source operatively connected to said electrode means for energizing said electrode means to ionize said gas in said chamber and produce light discharge fingers through at least some of said passages.

2. The luminous display device as claimed in claim 1 and further comprising:

phosphor coating on said protuberances.

3. A luminous display device as claimed in claim 1, wherein said rear member is a first rear member and said opening is in said first rear member, and further comprising:

a second rear member having a front side and a rear side, a generally central recess in said front side of said second rear member, a plurality of protuberances integral with and extending from said second rear member in said recess thereof toward said front side thereof, and a substantially flat peripheral front surface surrounding said recess thereof and engaging said rear side of said first rear member in fused sealing relationship therewith;

a second light discharge chamber between said recess in said second rear member and said rear side of said first rear member, said protuberances in said recess of said second rear member being in close adjacent relationship with respect to each other to form a second array of protuberances having light discharge passages therebetween extending through said second array;

said ionizable gas filling said second chamber;

an opening in said second rear member having an inner end communicating with said second chamber and an outer end;

said outer end of said opening in said first rear member communicating with said second chamber;

said electrode means communicating with said outer end of said opening in said second rear member; and said electrical power source ionizing said gas in said chamber in said first rear member and in said second chamber to produce light discharge fingers through at least some of said passages in said chambers.

4. The luminous display device as claimed in claim 3 wherein:

said protuberances in said second chamber comprise semi-spherical elements extending in close proximity to said rear side of said first rear member.

5. The luminous display device as claimed in claim 3 and further comprising:

at least one phosphor coating on said protuberances.

6. The luminous display device as claimed in claim 1, wherein:

said protuberances comprise semi-spherical elements extending in close proximity to said front member.

7. The luminous display device as claimed in claim 6 wherein:

said front and rear members are at least partially curved in shape.

8. The luminous display device as claimed in claim 7 wherein:

said front and rear members are curved in the shape of an arc of a circle.

9. The luminous display device as claimed in claim 7 wherein:

said front and rear members have an undulating shape.

10. The method of making a luminous display device comprising the steps of:

providing a front member of a sheet of transparent glass;

molding a rear member of glass having a substantially central recess in a front side thereof and a plurality of closely spaced protuberances integral with said rear member in said recess and extending toward said front side to form light discharge passages extending through interstices between said spaced protuberances;

fusing said front side of said rear member to said front member in an area surrounding said recess to form a sealed light discharge chamber between said front member and said recess and protuberances;

producing a hole through at least one of said front and rear members communicating with said chamber;

evacuating said chamber through said hole;

filling said chamber through said hole with ionizable gas;

installing an electrode in communicating relationship with said hole;

providing a power source; and energizing said electrode with said power source to ionize said gas in said chamber to produce fingers of light discharges through at least some of said passages.

* * * * *